US006739542B1

(12) United States Patent
Prina et al.

(10) Patent No.: US 6,739,542 B1
(45) Date of Patent: May 25, 2004

(54) MANUALLY-OPERATED SHRINK-WRAP DEVICE

(75) Inventors: Mauro Prina, Mar Vista, CA (US); Alan E. Fizer, Sacramento, CA (US)

(73) Assignee: Fizer Wrapper, Incorporated, Sacramento, CA (US)

( * ) Notice: Subject to any disclaimer, the term of this patent is extended or adjusted under 35 U.S.C. 154(b) by 0 days.

(21) Appl. No.: 10/254,459

(22) Filed: Sep. 24, 2002

Related U.S. Application Data

(60) Provisional application No. 60/324,697, filed on Sep. 25, 2001.

(51) Int. Cl.[7] ..... B65H 16/02; B65H 23/06

(52) U.S. Cl. ..... 242/423.2; 242/588.1; 242/588.2

(58) Field of Search ..... 242/423.2, 588.1, 242/588.2, 405, 405.3, 404.1

(56) References Cited

U.S. PATENT DOCUMENTS 734,797 A * 7/1903 Austin ..... 242/405.3
1,543,489 A * 6/1925 Wilson ..... 242/405.3
3,423,044 A * 1/1969 Beiderwell ..... 242/405.3
4,101,090 A * 7/1978 Wait, Jr. ..... 242/405.3
4,102,513 A * 7/1978 Guard ..... 242/423.2
4,226,380 A * 10/1980 Gay ..... 242/588.1
4,535,951 A 8/1985 Riemenschneider, III

* cited by examiner

*Primary Examiner*—John M. Jillions
(74) *Attorney, Agent, or Firm*—Cohen Sakaguchi & English LLP

(57) ABSTRACT

A manually-operated shrink-wrap device is described. The device includes a rigid support member having first and second sections, a handle at the first section, and a flexible leash attached to the second section. The rigid support member is adapted to support a film roll, and to facilitate rotational dispensing of film from the film roll to wrap the target load, which is typically a palletized load. The device also typically includes upper and lower film roll engagements for holding the film roll therebetween. A tensioning member may provide tension to the film roll along the longitudinal axis of the support member upon movement of one of the film roll engagements towards the tensioning member.

23 Claims, 3 Drawing Sheets

MANUALLY-OPERATED SHRINK-WRAP DEVICE

RELATED APPLICATIONS

Pursuant to 35 U.S.C §119(e) and any other applicable provisions, this application hereby claims priority to U.S. Patent Application Serial No. 60/324,697, filed on Sep. 25, 2001. The contents of U.S. Patent Application Serial No. 60/324,697, and of any other U.S. patent or other reference, if any, cited in this application, are hereby incorporated herein by reference.

The present invention relates generally to a device for wrapping objects. More particularly, the present invention relates to a device for supporting a roll of stretch film for manually wrapping palletized goods, containers and other objects.

BACKGROUND OF INVENTION

When goods are shipped on palettes or in assembled packages, it is common to wrap the load with a stretched film to avoid the goods from shifting or falling. The stretched film produces a tight wrap on the load and provides basic protection from the elements. Both manually-operated and fully-automated systems exist to wrap plastic film around goods.

Manually-operated devices typically require the operator to position themselves in awkward and physically demanding positions that may pose undue risk of back injury, depending upon the size, shape, and other characteristics of the load being wrapped. One such manually-operated device is described in U.S. Pat. No. 4,535,951 entitled "Stretch Film Wrapping Device", issued to Riemenschneider, III on Aug. 20, 1985. Specifically, the Riemenschneider device requires the operator to bend down low to wrap the bottom portion of the load, and to reach up high to wrap the top portion of the load. Similarly, to wrap load portions between the top and bottom, the operator must engage in a wide range of various positions in which the operator's back, arms, and legs, may be subject to undue strain. Such awkward use is required with the Riemenschneider device because all points of manual engagement are rigid and are fixed relative to the film roll.

Accordingly, there is a need for an improved manually-operated shrink-wrap device in which at least one point of manual engagement is flexible and not fixed, and in which the operator's arms are not required to be fixed relative to the film roll while wrapping loads.

SUMMARY OF INVENTION

A manually-operated shrink-wrap device is described. The device includes a rigid support member having first and second sections, a handle at the first section, and a flexible leash attached to the second section. The rigid support member is adapted to support a film roll, and to facilitate rotational dispensing of film from the film roll to wrap the target load, which is typically a palletized load. The device also typically includes upper and lower film roll engagements for holding the film roll therebetween. A tensioning member may provide tension to the film roll along the longitudinal axis of the support member upon movement of one of the film roll engagements towards the tensioning member.

The device of the present invention is used by: preparing the device for wrapping an object with the film, placing a section of the film against the object; and wrapping the object with the film, by rotationally dispensing the film from the film roll. Typically, this involves grasping both the handle and the leash to maintain control of the device. In this manner, awkward and physically demanding positions that may pose undue risk of back injury may be minimized or avoided altogether, because the operator's ability to maintain a generally upright position, even during wrapping of the upper and lower load portions, is facilitated by the flexible leash, as further shown and described herein. The operator's arms are thus not required to be fixed relative to the film roll while wrapping loads.

The present invention thus provides an improved manually-operated shrink-wrap device in which at least one point of manual engagement is flexible and not fixed, and in which the operator's arms are not required to be fixed relative to the film roll while wrapping loads.

DETAILED DESCRIPTION

Figure 1:
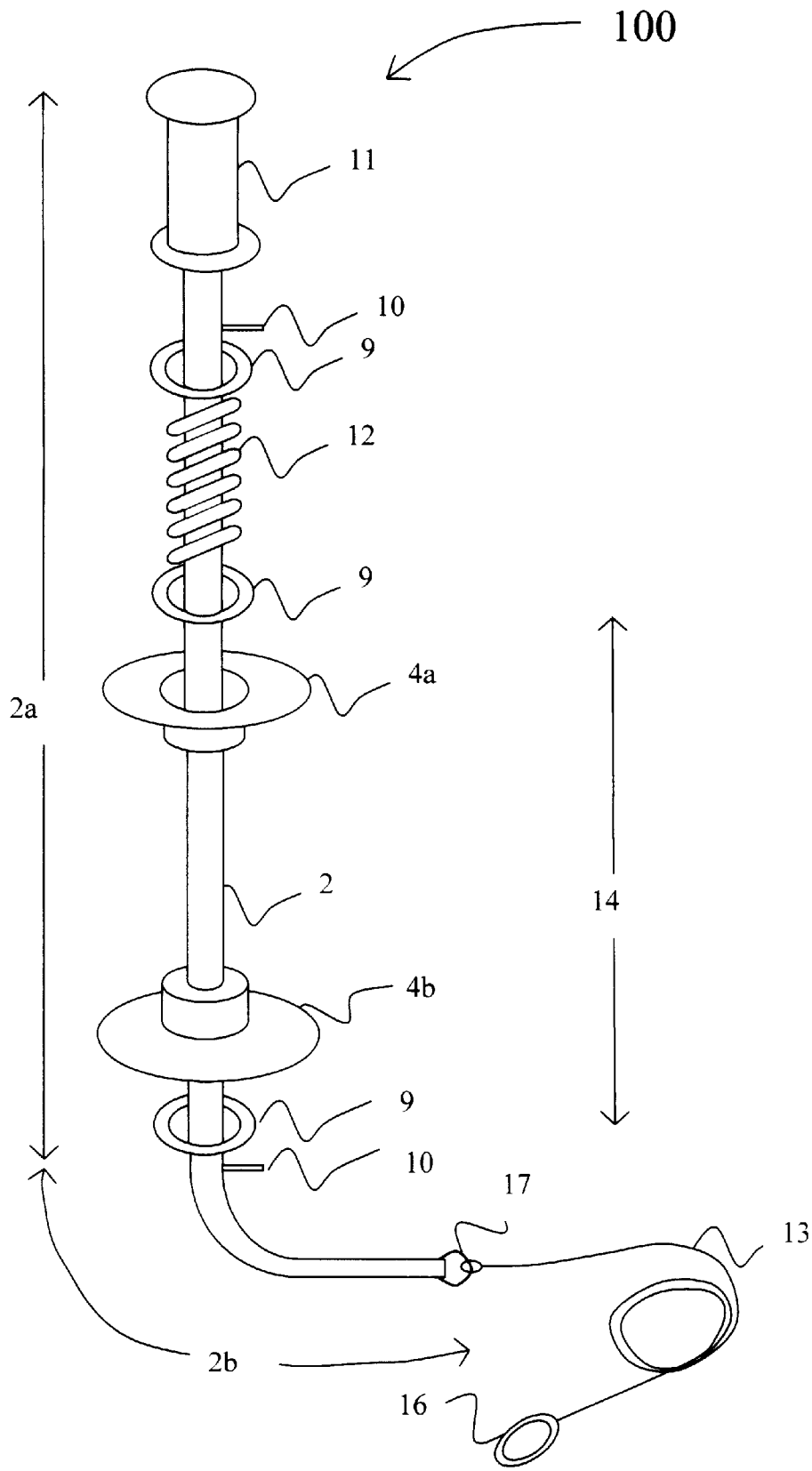
FIG. 1 is a perspective view of a preferred embodiment of a manually-operated shrink-wrap device in accordance with the present invention.

The present invention is a manually-operated shrink-wrap device 100, as seen in FIG. 1, and is preferably used with 12-inch, 15-inch, and 18-inch standard plastic film rolls, in the wrapping of palletized goods. However, the present invention may be used equally effectively with non-standard target goods to be wrapped. The invention, as described herein, optimizes the operator's handling of the device 100 by allowing the operator to easily wrap target goods at various heights.

The device 100 includes a rigid support member 2 having first and second sections 2*a* and 2*b* respectively. There is no definite starting or ending point between the two sections 2*a* and 2*b,* but rather these terms are used for reference to indicate an upper and lower portion, or proximal and distal portion generally, depending on the orientation of the device 100 at any given time. The first section 2*a* may include a handle 11 at the top thereof. Handle 11 shown in FIG. 1 is a simple grip fixed to first section 2*a* of rigid support member 2, but handle 11 may be removably attached to first section 2*a,* and may comprise an adjustment means or adjustment member (not shown) for vertical adjustment thereof relative to the rigid support member 2. The adjustment means/member may include, for example, a quick-release latch, or a rotational knob or bolt for engaging support member 2 upon tightening thereof. Adjustment of handle 11 may be desirable to activate a tensioning member such as spring 12 seen in FIG. 1, to provide variable tension or selected torque to the film roll 1 during operation of device 100. Second section 2*b* may be curved, as seen in FIG. 1, to provide clearance from film roll 1 during use.

The device also includes a flexible leash 13 attached to second section 2*b*. Flexible leash 13 may be leather, nylon, chain, cloth, plastic, or any other flexible material, as opposed to a rigid material such as a metal rod or wood. Flexible leash 13 may include features similar to known leashes for pets, such as automatic retraction. Flexible leash 13 may have a loop or hand grip 16 for convenient control thereof. Flexible leash 13 is attached to second section 2*b* of rigid support member 2 by any suitable means 17. For example, a ring, spring-clip, or common latch similar to those used to attach a dog leash to the dog's collar may be used. Thus flexible leash 13 may be removably attached to second section 2*b* of support member 2. Flexible leash 13 may also be fixed to second section 2*b* of support member 2. Flexible leash 13 allows the operator to change the height of device 100 from the ground, depending on the situation.

Figure 2:
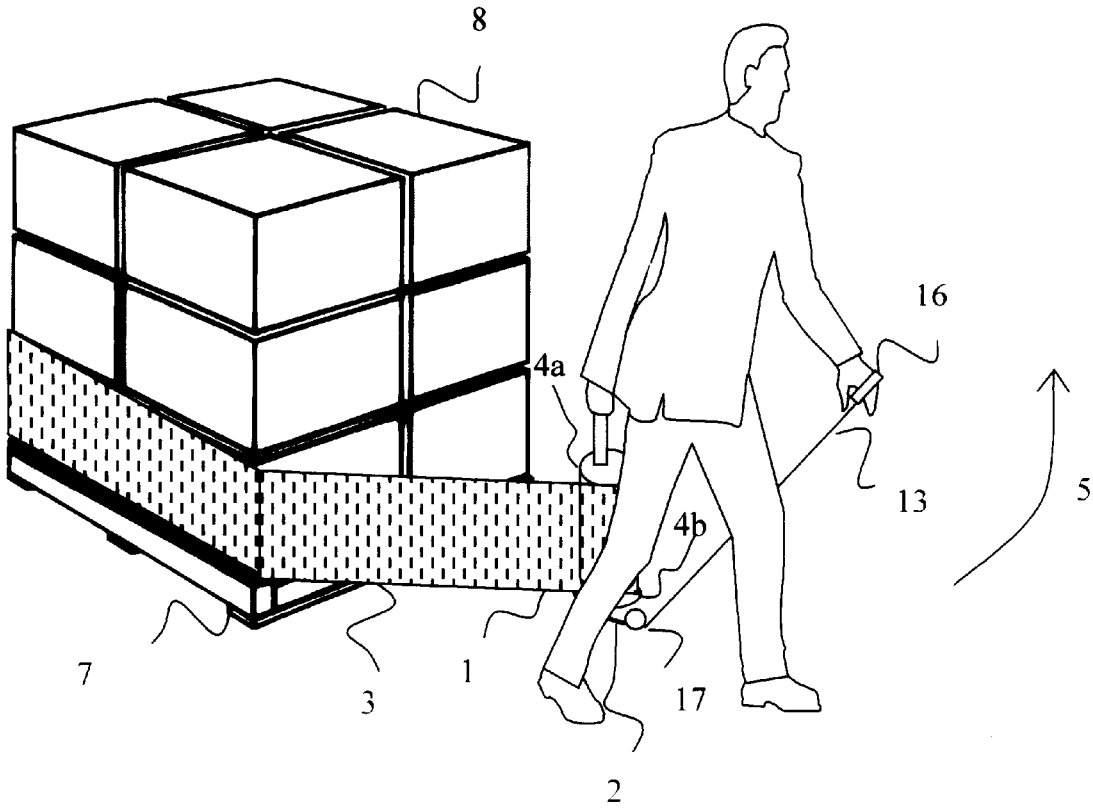
FIG. 2 shows the device of FIG. 1 being used to wrap palletized goods.

Rigid support member 2 is adapted to support a film roll 1, and to facilitate rotational dispensing of film 3 from film roll 1, to wrap the target load 8, which is typically on a palette 7 as seen in FIG. 2. Device 100 also typically includes upper and lower film roll engagements 4*a* and 4*b* respectively, for holding film roll 1 therebetween. Film roll engagements 4*a* and 4*b* are preferably positioned concentrically about support member 2. Film roll engagements 4*a* and 4*b* are shown separated in FIG. 1 for convenience, but such separation does not necessarily represent actual positions of the engagements 4*a* and 4*b* during use. For example, typically once film roll 1 is positioned on rigid support member 2 as seen in FIG. 2, engagement members 4*a* and 4*b* are forced upwardly and downwardly respectively to operative positions.

One or both of film roll engagements 4*a* and 4*b* may be movable along a longitudinal axis 14 of support member 2. On the other hand, one of film roll engagements 4*a* and 4*b* may be fixed, and even integrated with support member 2 as a single unit. In FIG. 1, both film roll engagement members 4*a* or 4*b* are shown as moveable, in which case a retaining means is used to prevent members 4*a* and 4*b* from vertical movement beyond a certain point. In FIG. 1, retaining means comprises a washer or washers 9 and associated pin 10. However, such means may be simply a metal plate, foam plate, tab, or other suitable means.

A tensioning member 12 may provide tension to the film roll 1 along longitudinal axis 14 of support member 2 upon movement of one of film roll engagements 4 towards tensioning member 12. In FIG. 1, tensioning member is a spring located between film roll engagement member 4*a*, and upper pin 10. Handle 11 may be moveable along longitudinal axis 14 of support member 2 towards tensioning member 12, to facilitate providing tension to film roll 1.

Figure 3:
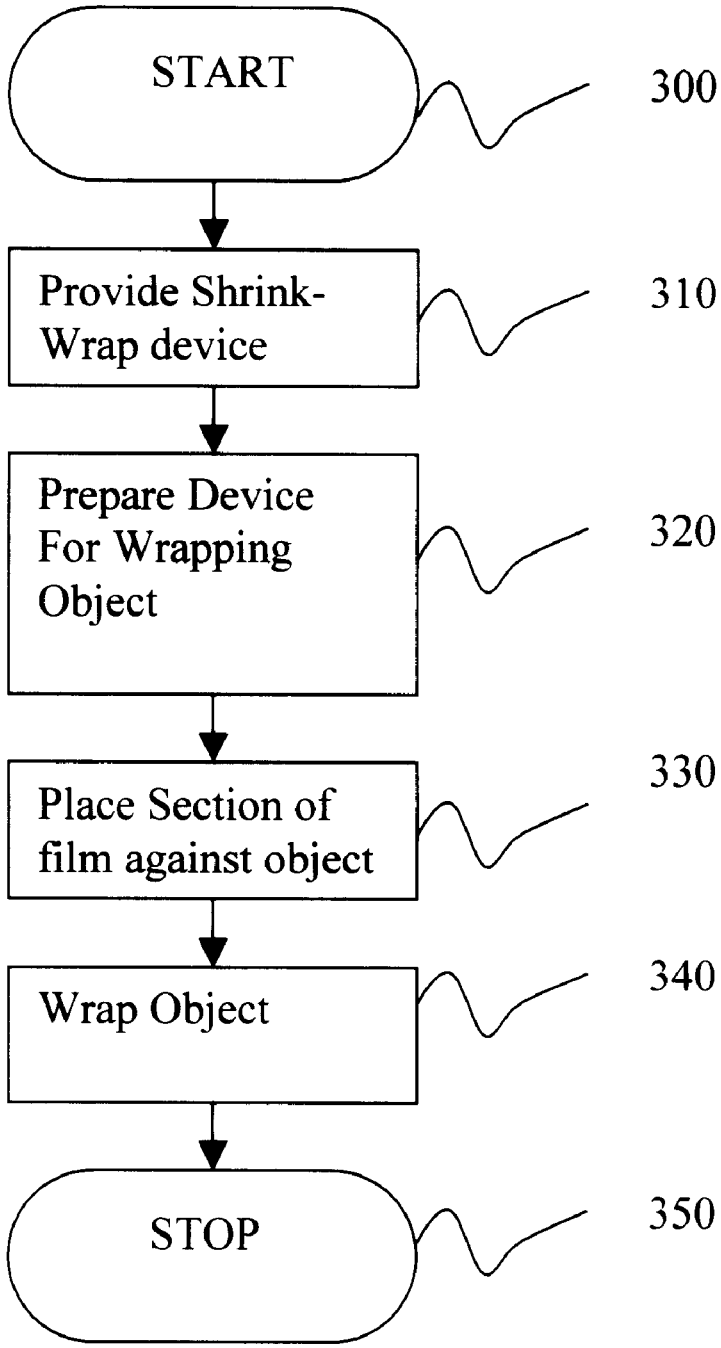
FIG. 3 is a flow chart illustrating a method of wrapping an object in accordance with the present invention.

Turning now to FIG. 3, a flow chart illustrating a method of wrapping an object in accordance with the present invention is shown. The process begins at step 300. At step 310, a manually-operated shrink-wrap device as described herein is provided. A manufacturer, distributor, or other third party may supply the device. In this respect, "providing" the device is intended to refer to the fact that such a device is in fact present in use with the method, and so the device may also be provided by the actual operator thereof.

At step 320, the device is then prepared for wrapping the target object with the film. The film roll may already be in place about the rigid support member, or the operator may place the film roll in place at this time. If the vertical position of the film roll needs adjusting, this may be facilitated by moving one of a plurality of film roll engagements along a longitudinal axis of the support member to provide tension to the film roll along said axis. Alternatively or in addition, an adjustment means of the handle may be used for vertical adjustment thereof relative to the rigid support member, thus also providing similar tension. The film roll engagements are typically positioned concentrically about the support member, as best seen in FIG. 1, such that they hold the film roll in place (see FIG. 2). Both the handle and the leash are grasped by the operator, as best seen in FIG. 2.

Once the device is prepared for use, a section of the film is placed against the target object at step 330, and the target object is then wrapped with the film at step 340, by rotationally dispensing the film from the film roll. The target object may include palletized goods as seen in FIG. 2, or other stacked goods or goods of non-standard shapes and sizes. The flexibility of the leash allows the operator to orient the device at various angles, positions, and heights, as needed. At step 340, either the operator may move while the goods remain stationary (as represented by arrow 5 in FIG. 2), or vice versa, or both may move. The process ends at step 350. Thus, using the device of the present invention as described herein, with the flexible leash, the target goods are successfully wrapped, and the operator is not exposed to undue risk of back, neck, or other physical injury.

While certain embodiments are illustrated in the drawings and are described herein, including preferred embodiments, it will be apparent to those skilled in the art that the specific embodiments described herein may be modified without departing from the inventive concepts described. For example, a fixed handle, as in U.S. Pat. No. 4,535,951, may be attached to the second section 2*b* of support member 2, to facilitate the wrapping operation when the height of the film roll 1 is at substantially the same height as the operator's waist. Accordingly, Applicants' invention as described herein is not to be restricted, except in accordance with the law by the claims which follow.

What is claimed is:

1. A manually-operated wrapping device comprising:

a rigid support member having an elongated first section and a second section;

a handle at a proximal portion of the first section; and a flexible leash attached to a distal portion of the second section;

wherein the proximal portion of the first section is at a proximal end of the rigid support member, and the distal portion of the second section is at a distal end of the rigid support member;

wherein the rigid support member is adapted to support a film roll, and to facilitate rotational dispensing of film from the film roll.

2. The device of claim 1, wherein the leash is removably attached to the second section.

3. The device of claim 1, wherein the second section is curved.

4. The device of claim 1, wherein the handle is removably attached to the first section.

5. The device of claim 4, wherein the handle comprises an adjustment means for vertical adjustment thereof relative to the rigid support member.

6. The device of claim 1, further comprising a plurality of film roll engagements for holding the film roll therebetween, said plurality of film roll engagements being positioned concentrically about the support member.

7. The device of claim 6, wherein one of the plurality of engagements is movable along a longitudinal axis of the support member.

8. The device of claim 7, further comprising a tensioning member which provides tension to the film roll along the longitudinal axis of the support member upon movement of the movable film roll engagement towards the tensioning member.

9. A method of wrapping an object comprising the steps:

providing a manually-operated wrapping device comprising: a rigid support member having an elongated first section and a second section; a handle at a proximal portion of the first section; and a flexible leash attached to a distal portion of the second section, wherein the proximal portion of the first section is at a proximal end of the rigid support member, and the distal portion of the second section is at a distal end of the rigid support member, and wherein the rigid support member is adapted to support a film roll, and to facilitate rotational dispensing of film from the film roll;

preparing the device for wrapping an object with the film;

placing a section of the film against the object; and wrapping the object with the film, by rotationally dispensing the film from the film roll.

10. The method of claim 9, further comprising the step of holding the film roll with a plurality of film roll engagements positioned concentrically about the support member.

11. The method of claim 10, wherein the holding step comprises the step of moving one of the plurality film roll engagements along a longitudinal axis of the support member.

12. The method of claim 11, wherein the step of moving one of the plurality of film roll engagements provides tension to the film roll along the longitudinal axis of the support member.

13. The method of claim 9, wherein the step of preparing comprises the step of grasping both the handle and the leash.

14. The method of claim 9, wherein the leash is removably attached to the second section.

15. The method of claim 9, wherein the second section is curved.

16. The method of claim 9, wherein the handle is removably attached to the first section.

17. The method of claim 16, wherein the handle comprises an adjustment means for vertical adjustment thereof relative to the rigid support member.

18. The method of claim 9, wherein the step of wrapping the object with the film is performed while grasping both the handle and the leash.

19. The method of claim 18, wherein the handle is grasped with one hand of a person operating the device, and the leash is grasped with the other hand of the person, and the arms of the person are not required to be fixed relative to the film roll while wrapping loads.

20. A manually-operated wrapping device comprising:

a rigid support member having an elongated first section and a second section;

a handle at a proximal portion of the first section;

a flexible leash attached to a distal portion of the second section;

a plurality of film roll engagements positioned concentrically about a longitudinal axis of the support member for holding a film roll, one of the plurality of engagements being movable along the longitudinal axis; and a tensioning member which provides tension to the film roll along the longitudinal axis upon movement of the movable film roll engagement towards the tensioning member;

wherein the proximal portion of the first section is at a proximal end of the rigid support member, and the distal portion of the second section is at a distal end of the rigid support member;

wherein the rigid support member is adapted to support the film roll, and to facilitate rotational dispensing of film from the film roll; and wherein the handle has an adjusting member.

21. The device of claim 20, wherein the leash is removably attached to the second section.

22. The device of claim 20, wherein the handle is removably attached to the first section.

23. The device of claim 20, wherein the handle is moveable along the longitudinal axis of the support member towards the tensioning member, to facilitate providing tension to the film roll.

* * * * *